US008327608B2

(12) United States Patent
Ebitz

(10) Patent No.: US 8,327,608 B2
(45) Date of Patent: Dec. 11, 2012

(54) METHOD OF COVERING, PREVENTING DEBRIS AND INSECTS FROM ENTERING, MINIMIZING HEAT TRANSFER, AND STABILIZING A CUP OR CAN FILLED WITH A LIQUID BEVERAGE MATERIAL, AND DEVICE THEREFOR

(76) Inventor: Robert Ebitz, Greensburg, PA (US)

( * ) Notice: Subject to any disclaimer, the term of this patent is extended or adjusted under 35 U.S.C. 154(b) by 188 days.

(21) Appl. No.: 12/894,798

(22) Filed: Sep. 30, 2010

(65) Prior Publication Data

US 2012/0080428 A1 Apr. 5, 2012

(51) Int. Cl.
*B65B 7/28* (2006.01)

(52) U.S. Cl. ..... 53/471; 53/468; 53/478; 53/485

(58) Field of Classification Search ..... 53/467, 53/468, 471, 478, 485, 488
See application file for complete search history.

(56) References Cited

U.S. PATENT DOCUMENTS

| | | | | |
|---|---|---|---|---|
| 3,864,898 | A * | 2/1975 | West | 53/328 |
| 4,594,838 | A * | 6/1986 | Ficken et al. | 53/471 |
| 4,736,568 | A * | 4/1988 | Shaw et al. | 53/297 |
| 4,949,526 | A * | 8/1990 | Brogna et al. | 53/306 |
| 5,000,345 | A * | 3/1991 | Brogna et al. | 221/5 |
| 5,661,889 | A * | 9/1997 | Valyi | 29/416 |
| 6,544,159 | B2 * | 4/2003 | Sireix | 493/308 |
| 7,089,718 | B2 * | 8/2006 | Biba et al. | 53/557 |
| 7,886,505 | B1 * | 2/2011 | Dunaway | 53/452 |
| 2010/0107568 | A1 * | 5/2010 | Inaba et al. | 53/478 |
| 2010/0308046 | A1 * | 12/2010 | Serra | 220/212 |

* cited by examiner

*Primary Examiner* — Christopher Harmon
(74) *Attorney, Agent, or Firm* — Nils H. Ljungman & Associates

(57) ABSTRACT

A method of covering, preventing debris and insects from entering, minimizing heat transfer, and stabilizing a cup or can filled with a liquid beverage material, and device therefor.

3 Claims, 9 Drawing Sheets

METHOD OF COVERING, PREVENTING DEBRIS AND INSECTS FROM ENTERING, MINIMIZING HEAT TRANSFER, AND STABILIZING A CUP OR CAN FILLED WITH A LIQUID BEVERAGE MATERIAL, AND DEVICE THEREFOR

BACKGROUND

1. Technical Field

The present application relates to a method of covering, preventing debris and insects from entering, minimizing heat transfer, and stabilizing a cup or can filled with a liquid beverage material, and device therefor.

2. Background Information

Background information is for informational purposes only and does not necessarily admit that subsequently mentioned information and publications are prior art.

Cups come in a variety of shapes and sizes. Some cups may have an inner diameter of the mouth of two and seven-eighth inches. Some cups have an inner diameter of three and one-eighth inches. Some cups may have an inner diameter of the mouth of three and one-fourth inches. Some cups may have diameters that are less than two and seven-eighth inches. Some cups may have diameters that are greater than three and one-fourth inches.

Open-mouthed containers may be used to hold hot or cold beverages, such as carbonated beverages, water, juices, fruit drinks, alcoholic beverages such as beer or wine, coffee, tea, and other similar beverages. Such open-mouthed containers may include plastic cups, mugs, glasses, and beverage cans, among other similar containers.

DESCRIPTION OF EMBODIMENT OR EMBODIMENTS

Figure 1:
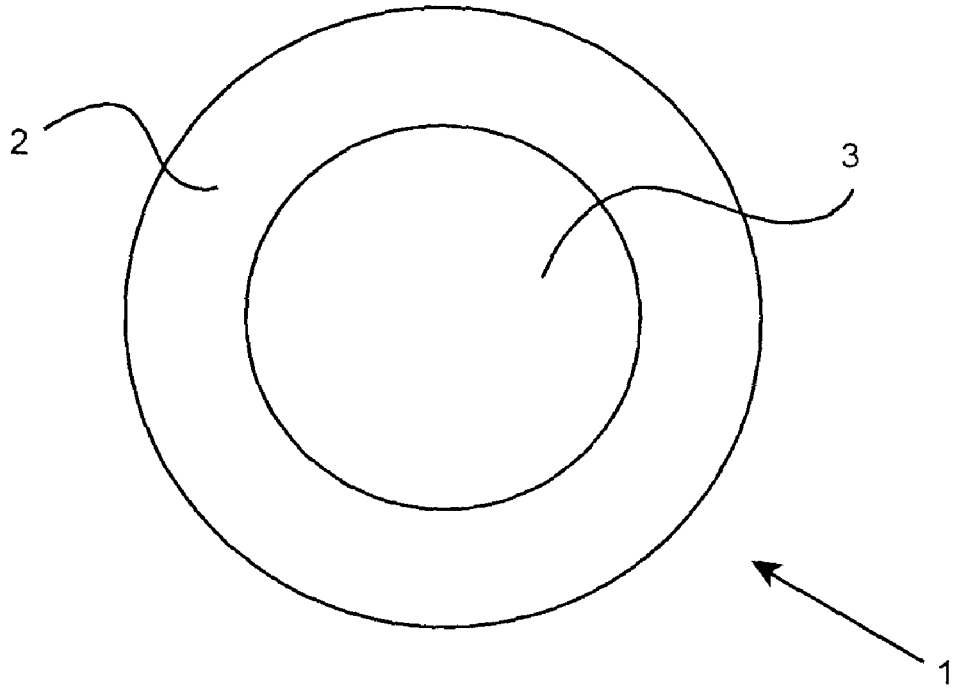
FIG. 1 is a top view of one possible embodiment of the present application.

The cup cover 1, as seen in FIG. 1, may be configured to restrict or minimize foreign objects, debris, and/or insects such as bees, flies, and spiders from entering a cup filled with a beverage or with food.

Figure 2:
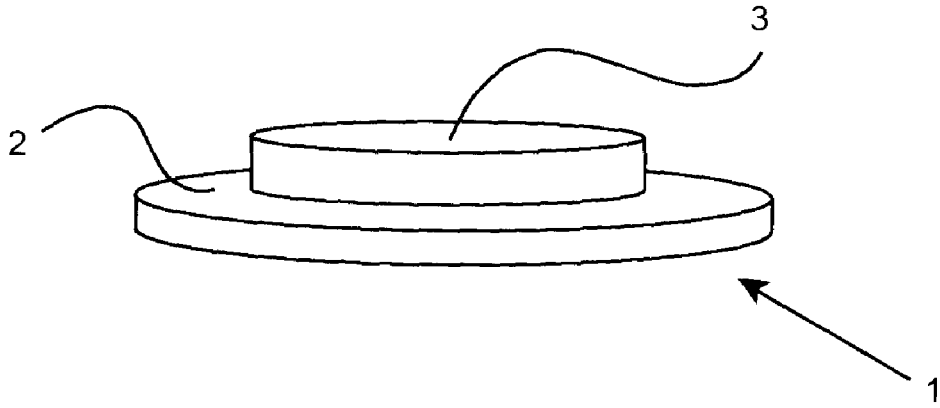
FIG. 2 is a side perspective view of the embodiment shown in FIG. 1.

In one possible embodiment of the present application, the cup cover 1 may comprise a lip portion 2 and a protruding portion 3, as seen in FIGS. 1 and 2. The cup cover 1 of the present application may comprise plastic, possibly with a sanitary finish to minimize or restrict accumulation of dirt on the cup cover.

Figure 3:
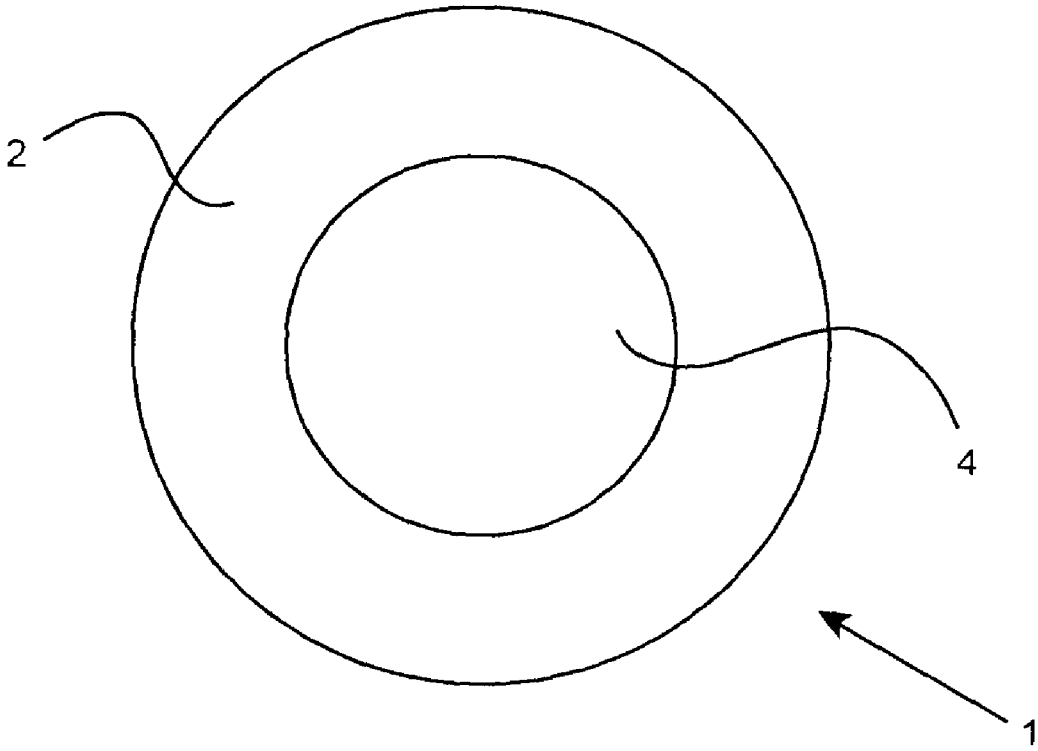
FIG. 3 is a bottom view of the embodiment shown in FIGS. 1 and 2.

As seen in FIG. 3, the cup cover 1 may also comprise a hollow portion 4 along with the lip 2. The hollow portion 4 of FIG. 3 corresponds to the protruding portion 3 of FIGS. 1 and 2.

Figure 1A:
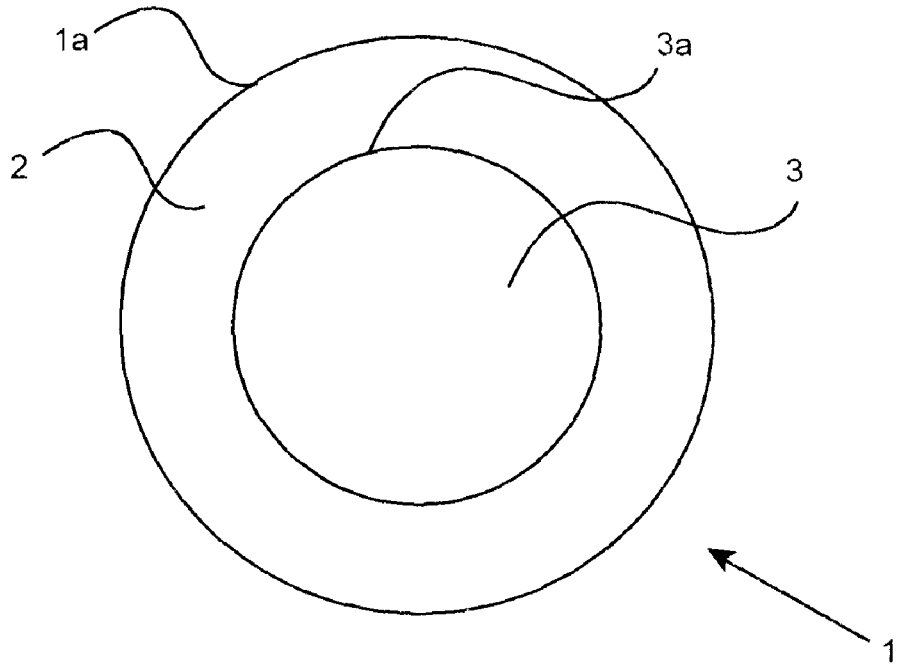
FIG. 1*a* is a top view of another possible embodiment of the present application.

In one possible embodiment of the present application, as shown in FIG. 1A, the cup cover 1 may have a diameter 1*a* of about four inches. In other embodiments of the present application, this diameter 1*a* may be greater or lesser. In one possible embodiment, the protruding portion 3 of the cup cover 1 may have a diameter 3*a* of approximately two and three-eighth inches. In other embodiments of the present application, the diameter 3*a* of the protruding portion 3 of the cup cover 1 may be greater or lesser.

Figure 2A:
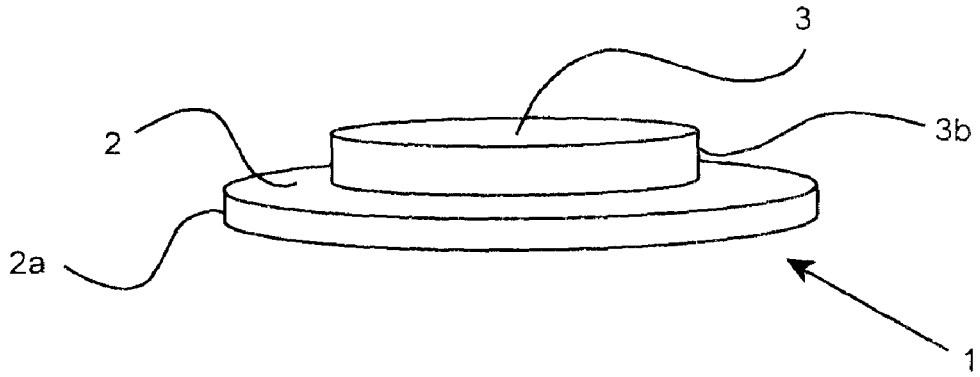
FIG. 2*a* is a side perspective view of the embodiment shown in FIG. 1*a;*

In one possible embodiment of the present application, the total height of the cup cover 1, seen in FIG. 2A as the combination of the height 3*b* of the protrusion 3 and the height 2*a* of the lip 2, may comprise about three-fourths of an inch. In one possible embodiment, the diameter 1*a* of the cup cover 1 may be large enough to cover the diameter of large-mouthed cups. In one possible embodiment, the diameter 3*a* of the protruding portion or protrusion 3 of the cup cover 1 may be small enough to fit into small-mouthed cups. In one possible embodiment, the diameter of the hollow portion may be sufficiently large to fit over the lips of beverage cans.

Figure 3A:
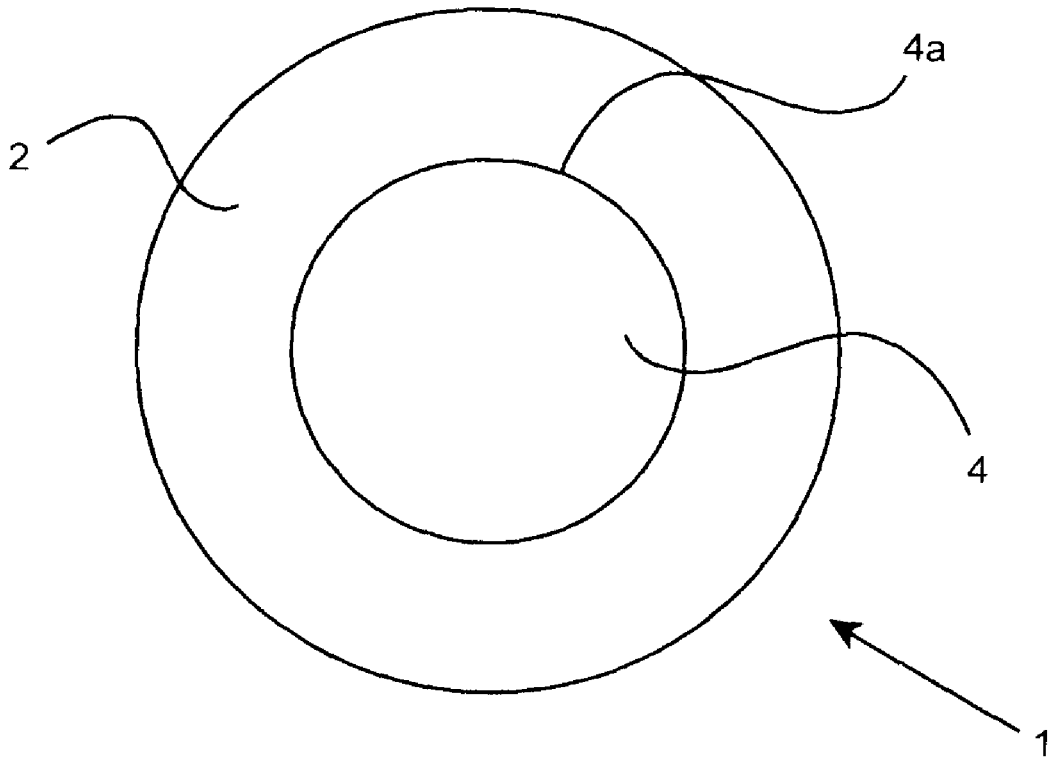
FIG. 3*a* is a bottom view of the embodiment shown in FIGS. 1*a* and 2*a;*

In one possible embodiment of the present application, the diameter 1*a* of the cup cover 1 may be three and five-eighth inches. The protruding portion 3 may have a diameter 3*a* of two and one-half inches. As seen in FIG. 3A, the hollow portion 4 may have a diameter 4*a* of two and one-fourth inches. The proportion of the diameter 1*a* of the cup cover 1 to the diameter 3*a* of the protrusion 3 may be the same for cup covers made for larger or smaller cups. In another possible embodiment, the proportion of the diameter 1*a* to the diameter 3*a* may be greater or lesser.

The height 3*b* of the protruding portion 3 may be three-eighths of an inch. The thickness 2*a* of the lip 2 of the cup cover 1 may comprise one-eighth of an inch. The total height of the cup cover 1, the combination of the height 3*b* and the thickness 2*a*, may be half an inch. The depth of the hollow portion 4 may be seven-sixteenths of an inch. The thickness of the cup cover 1 may be sufficiently thick so as not to deform a cup.

The dimensions of the cup cover 1 may increase or decrease in increments of one percent, up to and including forty percent of the dimensions. The ratio or proportion of the dimensions may stay the same in relation to one another. In other possible embodiments of the present application, the ratio or proportion may increase or decrease in increments of one percent.

The hollow portion 4 of the cup cover 1 of the present application may reduce the weight of the cup cover 1, so the cup cover 1 may not deform a cup and so the cup may not be excessively top heavy.

The weight of the cup cover 1 may be 1.1 ounces. The weight may be increased or decreased up to forty percent, in one percent increments. The weight of the cup cover 1 may be adjusted in relation to changes made in the diameters of the cup cover 1, protruding portion 3, and hollow portion 4 as well as the height of the cup cover 1, the height of the protruding portion 3, and the thickness of the lip 4. The size and/or shape of the cup cover 1 may correspond to the weight of the cup cover 1. A cup cover 1 may be altered with different weights and sizes for different cups, which may be of varying sizes, shapes, and weights. Different cup covers 1 may also be used for different cup contents, since the weights of a cup's contents may vary depending on the type of beverage and/or food in the cup, in order to maximize the stability of the cup 5.

Figure 4:
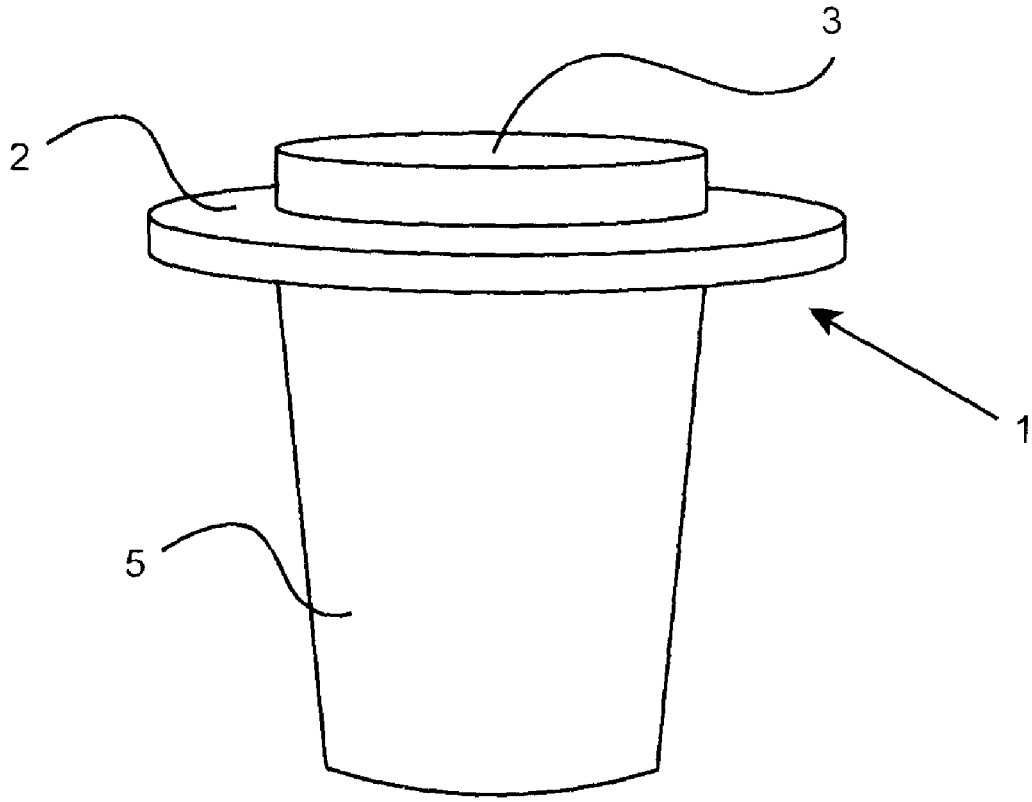
FIG. 4 shows one possible embodiment of the present application in use with a cup.
Figure 5:
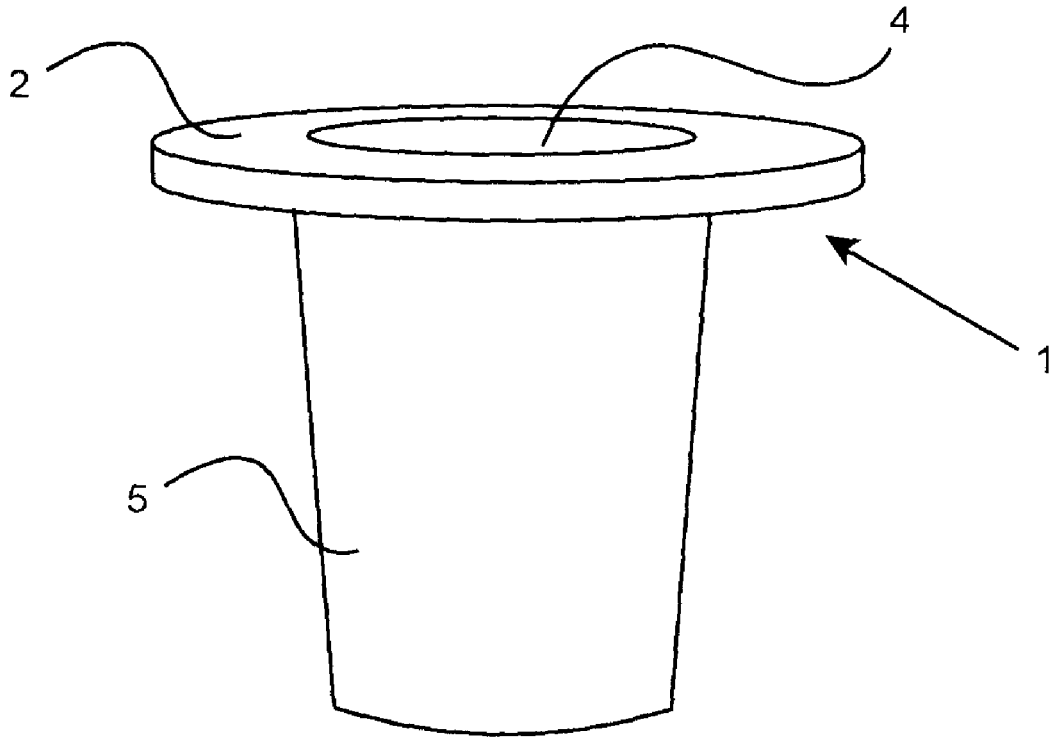
FIG. 5 shows one possible embodiment of the present application in use with a cup.
Figure 6:
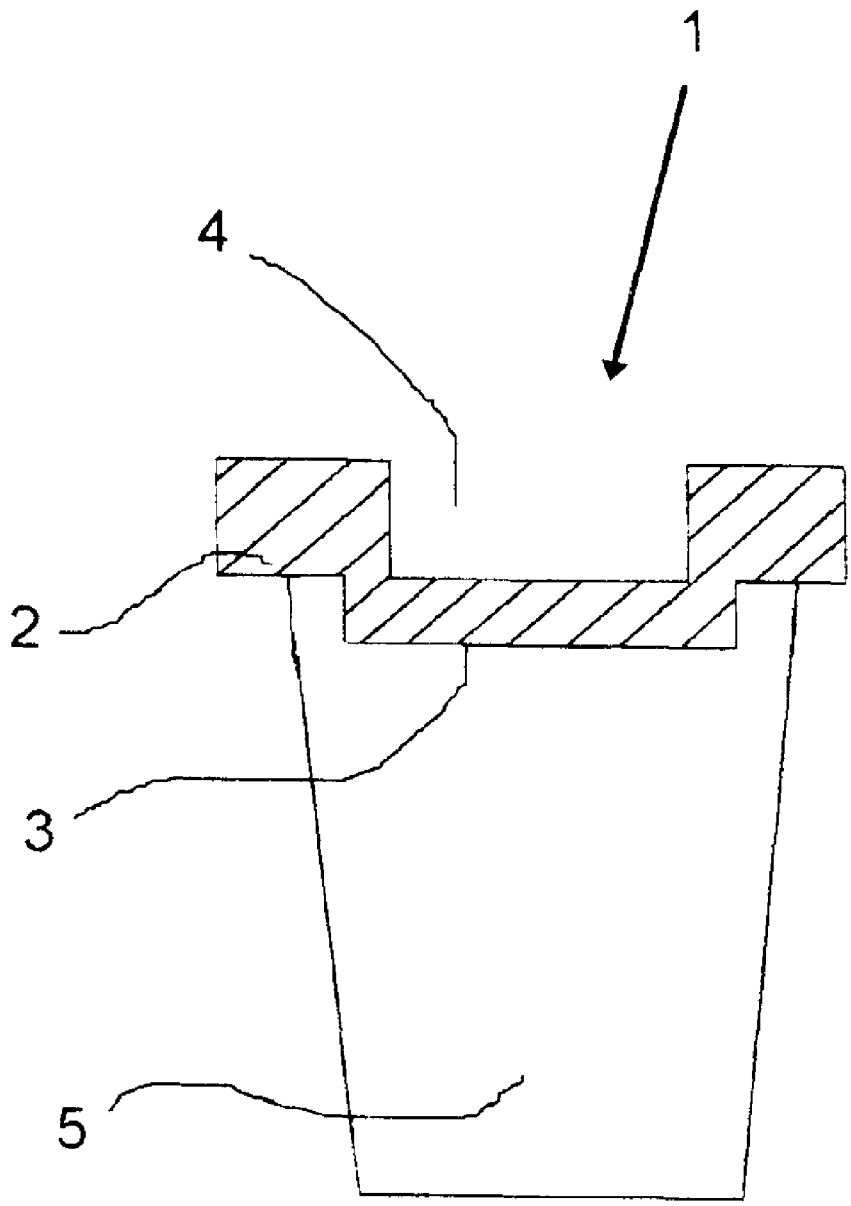
FIG. 6 is a cross section of a cup cover in use with a cup.

The lip 2 of the cup cover 1 may rest against the edge or lip of a cup 5, as shown in FIGS. 4, 5, and 6. In another possible embodiment of the present application, such as the embodiment seen in FIG. 4, the protruding portion 3 of the cup cover 1 may point up from the cup 5. In other words, the protruding portion 3 may point up and stick away from the cup 5, as shown in FIG. 4. In such an embodiment, the protruding portion 3 may be used as a handle.

In one possible embodiment of the present application, as shown in FIG. 5, the protruding portion 3 of the cup cover 1 may fit into the cup 5 on which the cup cover 1 is resting. The protrusion 3 of the cup cover 1 may be smaller than the mouth of the cup 5 to permit movement of the cup cover 1 on the cup 5.

The protrusion 3 of the cup cover 1 may also restrict and/or minimize the cup cover 1 from sliding off the cup 5 or dislodging upon the cup 5 being pushed and/or moved. The cup cover 1 may also minimize a cup 5, for example a ceramic cup 5 or mug 5, from chipping if the cup 5 is tipped over or knocked over. The lip 2 of the cup cover 1 may extend over the mouth of cup 5, as seen in FIGS. 4, 5, and 6, and absorb the force of the fall.

The cup cover 1 may reduce the inertia of movements of the cup 5, thereby reducing or minimizing the likelihood of the cup 5 being knocked over when bumped or moved away from the user. The cup cover 1 may act as a stabilizer upon a sudden and/or abrupt movement of the cup 5 or may substantially stabilize a cup 5 during an abrupt movement. The cup cover 1 may also stabilize the cup 5 if the cup 5 is moved inadvertently or abruptly by accident to minimize the cup 5 from being knocked over and spilling the cup contents. The cup cover 1 may also minimize or restrict sloshing or splashing of the contents of the cup 5 while being repeatedly moved or bumped. The cup cover 1 may also minimize the contents from spilling away the user or onto the user.

In at least one possible embodiment of the present application, the cup cover 5 may stabilize a cup and restrict or minimize a cup 5 from tipping over if a user pushes the cup 5 away suddenly, abruptly, or accidentally. The cup cover 1 may be configured to stabilize the cup for a sufficiently long period of time, so that the user may then be able to react and grab the cup 5 before the cup 5 would tip over and spill the contents from the cup 5.

In at least one possible embodiment of the present application, the cup cover 1 may be configured to insulate the beverage or food in the cup 5. The cup cover 1 may be configured to keep hot beverages warm and/or keep cold beverages cool.

Figure 7:
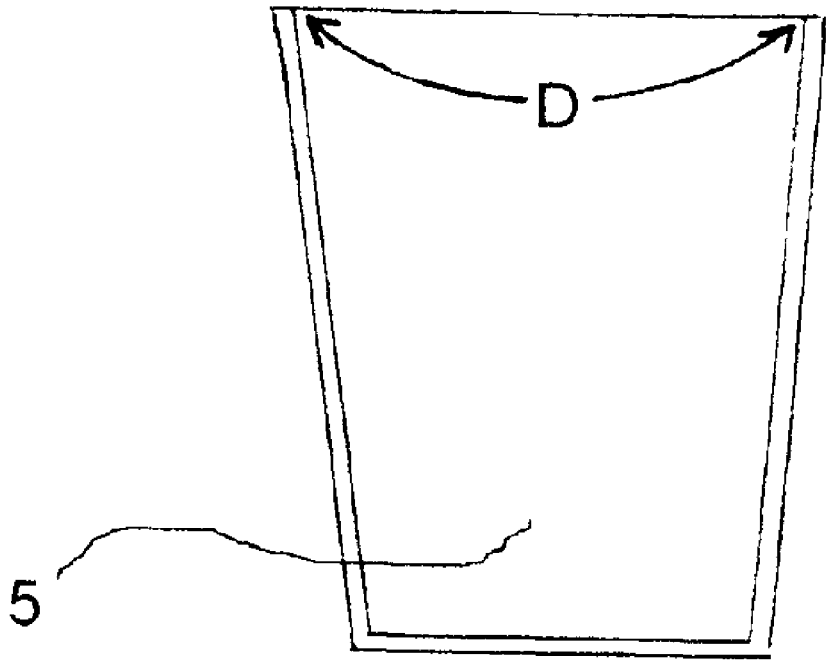
FIG. 7 shows a cup with an inner diameter of the mouth of the cup.

FIG. 6 shows a cross section of a cup cover 1 in use with a cup 5. The cup cover 1 is disposed on the cup 5 with the protruding portion 3 pointing downwardly into the cup 5. In one possible embodiment of the present application, the cup 5 may comprise an inner diameter D of a mouth, as seen in FIG. 7, of about two and seven-eighth inches. In such an embodiment, the protruding portion 3 may have a diameter 3*a* of about two and one-half inches. In such an embodiment, there may be a non-zero gap between the lip of the cup 5 and the protruding portion 3 of the cup cover 1 of up to three-eighths of an inch. This gap may promote stability of the cup 5, restricting and minimizing the cup 5 from being tipped or knocked over.

In at least one possible embodiment of the present application, the diameter 3*a* of the protruding portion 3 may be varied upon experimentation to determine what ratio of the diameter 3*a* to the inner diameter D of a cup 5 sufficiently minimizes or reduces instability of the cup 5. In at least one possible embodiment, the diameter 3*a* may be ninety percent of the diameter D of the cup 5. In another possible embodiment, the diameter 3*a* may be eighty percent of the diameter D of the cup 5. In another possible embodiment, the diameter 3*a* may be seventy-seven percent of the diameter D of the cup 5.

Figure 8:
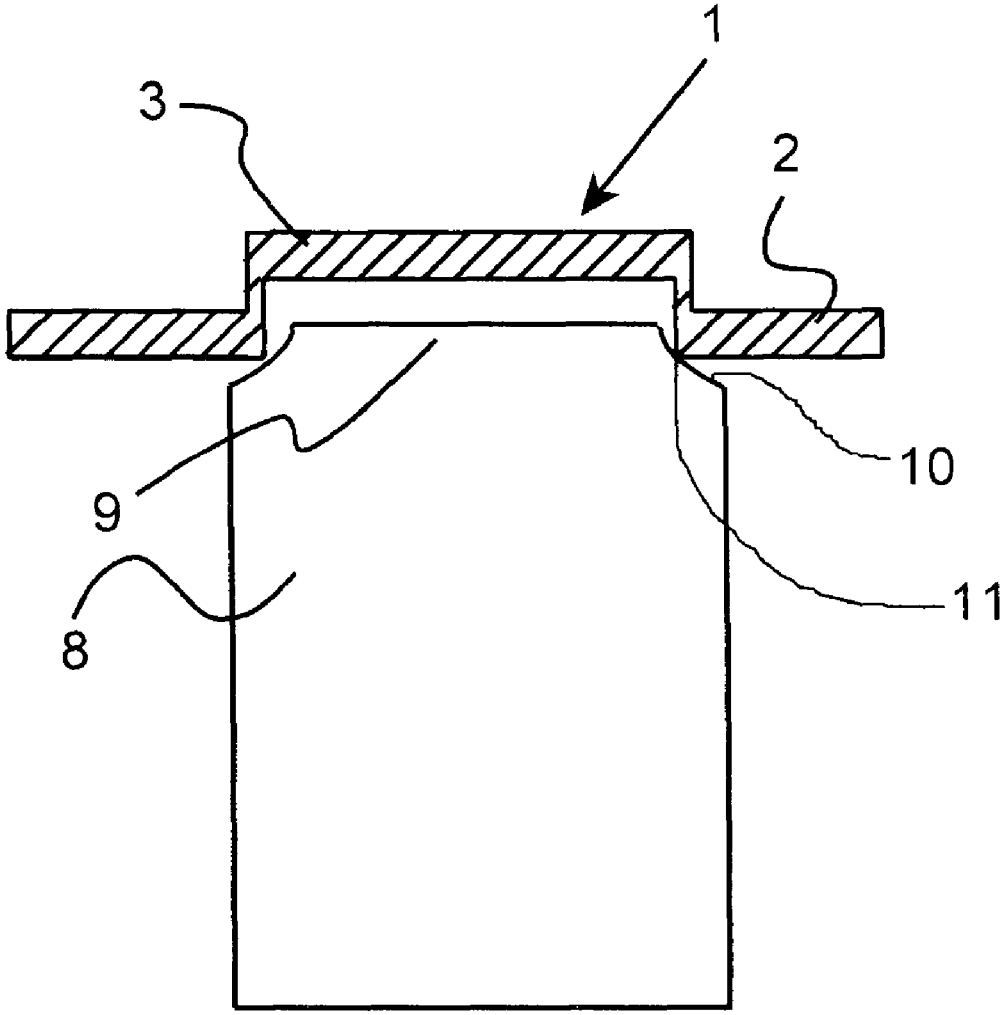
FIG. 8 shows a cross-section of a cup cover in use with a beverage can.

In at least one possible embodiment shown in FIG. 8, the cup cover 1 may be placed such that the hollow portion may be placed in a form-fitting, semi-form-fitting manner, or a fit with gaps over an upper or top or lip portion 9 of a can 8, such as a beverage can for holding such beverages as soda or beer. Such cans may comprise a lip portion 9 as well as a curved shoulder or chamfer 10. The inner diameter 4*a* of the hollow portion 4 (shown in FIG. 4) is such that the diameter closely follows the diameter of the outer lip of a can, such as a twelve-ounce size or similar beverage can, or the diameter could be slightly larger, depending on the size of the inner diameter 4*a* and the size of the diameter of the lip portion 9 of the can 8. The beverage container cover 1 may contact the can 8 at a point of contact 11. In this manner, the user can cover an opened can 8 with the cup cover 1 reasonably secured against becoming dislodged from or sliding off of the can 8.

One feature or aspect of an embodiment is believed at the time of the filing of this patent application to possibly reside broadly in a method of covering, preventing debris and insects from entering, minimizing heat transfer, and stabilizing a cup filled with a liquid beverage material, said method comprising the steps of: selecting an empty cup, which cup comprises a cup mouth with an inner diameter of about two and seven-eighth inches; selecting a round cup cover, which cup cover comprises: a hard, smooth plastic material configured to: minimize dirt accumulation on said cup cover; maximize cleanability; and be sufficiently sturdy to be handled and to minimize breaking or deforming of said cup cover during handling and during use; a color on the top of said cup cover configured to reflect heat away from said cup cover; a color on the bottom of said cup cover configured to reflect heat back toward the contents of said cup; a weight about one and one-tenth ounces, which corresponds to a proportion to the weight of said cup and to the weight of a liquid beverage material, and configured to substantially minimize instability of the cup with liquid beverage material and minimize spilling of liquid beverage material from the cup; a diameter of about three and five-eighth inches; a lip portion comprising: an outer diameter of about three and five-eighth inches; and a thickness of about one-eighth of an inch; a protruding portion comprising: a diameter of about two and one-half inches being concentric with said outer diameter of said lip portion; said diameter being substantially greater than the radius of said cup and substantially but leaving a gap between said protruding portion and at least one area of the periphery of said cup mouth; and a height, protruding from said lip portion, of about three-eighths of an inch; a hollow portion comprising: a diameter of about two and one-fourth inches being concentric with said outer diameter of said lip portion and said diameter of said protruding portion; and a depth of about seven-sixteenths of an inch; filling said empty cup at least partially with a liquid beverage material; placing said cup cover on top of said at least partially filled cup, such that said protruding portion fits extends into said cup mouth of said at least partially cup; covering said cup mouth with said lip portion of said cup cover such that said lip portion extends beyond the outer diameter of said at least partially filled cup and thus minimizing insects and debris from entering said at least partially filled cup; minimizing instability of said at least partially filled cup with said cup cover disposed on said at least partially filled cup; insulating said liquid beverage material in said at least partially filled cup with said cup cover; inadvertently moving said at least partially filled cup such that said cup cover moves within a predetermined distance of three-eighths of an inch on top of said at least partially filled cup, which predetermined distance is a gap being sufficiently large to minimize instability of said at least partially filled cup; minimizing spilling of liquid beverage material from said at least partially filled cup with said cup cover by the impact of said liquid beverage material in said at least partially filled cup; picking up said at least partially filled cup; removing said cup cover from said at least partially filled cup; drinking from said at least partially filled cup; replacing said cup cover on said at least partially filled cup; removing said cup cover from said cup; opening a beverage can, which beverage can comprises a lip portion and a can mouth; placing said cup cover on said opened beverage can such that said hollow portion of said cup cover fits over said lip portion and said can mouth of said opened beverage can; minimizing insects and debris from entering said opened beverage can; minimizing instability of said opened beverage can with said cup cover disposed on said beverage can; insulating said liquid beverage material in said beverage can with said cup cover; inadvertently moving said beverage can such that said cup cover rocks on top of said beverage can and minimizing instability of said beverage can; minimizing spilling of liquid beverage material from said beverage can with said cup cover by the impact of said liquid beverage material in said at least partially filled cup; picking up said beverage can; removing said cup cover from said beverage can; and drinking from said beverage can.

Another feature or aspect of an embodiment is believed at the time of the filing of this patent application to possibly reside broadly in a method of covering, preventing debris and insects from entering, minimizing heat transfer, and stabilizing a cup filled with a liquid beverage material, said method comprising the steps of: selecting an empty cup, which cup comprises a cup mouth with an inner diameter and a radius; selecting a round cup cover, which cup cover comprises: a protruding portion, which protruding portion comprises a diameter in the range of about seventy percent of the radius of the cup mouth to about ninety percent of the radius of the cup mouth; a hollow portion corresponding to said protruding portion; and a lip portion surrounding said protruding portion and said hollow portion; filling said empty cup at least partially with a liquid beverage material; placing said cup cover on top of said at least partially filled cup, such that said protruding portion extends into said cup mouth of said at least partially cup; covering said cup mouth with said lip portion of said cup cover such that said lip portion extends beyond said cup mouth of said at least partially filled cup and thus minimizing insects and debris from entering said at least partially filled cup; minimizing instability of said at least partially filled cup with said cup cover disposed on said at least partially filled cup; insulating said liquid beverage material in said at least partially filled cup with said cup cover; inadvertently moving said at least partially filled cup such that said cup cover moves within a predetermined distance on top of said at least partially filled cup, which predetermined distance is a gap being sufficiently large to minimize instability of said at least partially filled cup; minimizing spilling of liquid beverage material from said at least partially filled cup with said cup cover by the impact of said liquid beverage material in said at least partially filled cup; picking up said at least partially filled cup; removing said cup cover from said at least partially filled cup; drinking from said at least partially filled cup; and replacing said cup cover on said at least partially filled cup.

Yet another feature or aspect of an embodiment is believed at the time of the filing of this patent application to possibly reside broadly in a beverage container cover configured to be used in a method of covering a beverage container, preventing debris and insects from entering a beverage container, minimizing heat transfer, and stabilizing a beverage container filled with a liquid beverage material, said beverage container cover comprising: a round shape; a hard, smooth plastic material configured to: minimize dirt accumulation on said beverage container cover; maximize cleanability; and be sufficiently sturdy to be handled and to minimize breaking or deforming of said beverage container cover during handling and during use; a color on the top of said beverage container cover configured to reflect heat away from said beverage container cover; a color on the bottom of said beverage container cover configured to reflect heat back toward the contents of said cup; a weight about one and one-tenth ounces, which corresponds to a proportion to the weight of a beverage container and to the weight of a liquid beverage material, and configured to substantially minimize instability of the beverage container with liquid beverage material and minimize spilling of liquid beverage material from the beverage container; a diameter of about three and five-eighth inches; a lip portion comprising: an outer diameter of about three and five-eighth inches; and a thickness of about one-eighth of an inch; a protruding portion comprising: a diameter of about two and one-half inches being concentric with said outer diameter of said lip portion; said diameter being substantially greater than the radius of a beverage container and substantially but leaving a gap between said protruding portion and at least one area of the periphery of a mouth of a beverage container; and a height, protruding from said lip portion, of about three-eighths of an inch; a hollow portion comprising: a diameter of about two and one-fourth inches being concentric with said outer diameter of said lip portion and said diameter of said protruding portion; and a depth of about seven-sixteenths of an inch; said method comprising the steps of: selecting an empty cup, which cup comprises a mouth with an inner diameter of about two and seven-eighth inches; selecting said beverage container cover; filling said empty cup at least partially with a liquid beverage material; placing said beverage container cover on top of said at least partially filled cup, such that said protruding portion fits extends into said cup mouth of said at least partially cup; covering said cup mouth with said lip portion of said beverage container cover such that said lip portion extends beyond the outer diameter of said at least partially filled cup and thus minimizing insects and debris from entering said at least partially filled cup; minimizing instability of said at least partially filled cup with said beverage container cover disposed on said at least partially filled cup; insulating said liquid beverage material in said at least partially filled cup with said beverage container cover; inadvertently moving said at least partially filled cup such that said beverage container cover moves within a predetermined distance of three-eighths of an inch on top of said at least partially filled cup, which predetermined distance is a gap being sufficiently large to minimize instability of said at least partially filled cup; minimizing spilling of liquid beverage material from said at least partially filled cup with said beverage container cover by the impact of said liquid beverage material in said at least partially filled cup; picking up said at least partially filled cup; removing said beverage container cover from said at least partially filled cup; drinking from said at least partially filled cup; replacing said beverage container cover on said at least partially filled cup; removing said beverage container cover from said cup; opening a beverage can, which beverage can comprises a lip portion and a can mouth; placing said beverage container cover on said opened beverage can such that said hollow portion of said beverage container cover fits over said lip portion and said can mouth of said opened beverage can; minimizing insects and debris from entering said opened beverage can; minimizing instability of said opened beverage can with said beverage container cover disposed on said beverage can; insulating said liquid beverage material in said beverage can with said beverage container cover; inadvertently moving said beverage can such that said beverage container cover rocks on top of said beverage can and minimizing instability of said beverage can; minimizing spilling of liquid beverage material from said beverage can with said beverage container cover by the impact of said liquid beverage material in said at least partially filled cup; picking up said beverage can; removing said beverage container cover from said beverage can; and drinking from said beverage can.

Still another feature or aspect of an embodiment is believed at the time of the filing of this patent application to possibly reside broadly in a cup cover configured to be used in a method of covering, preventing debris and insects from entering, minimizing heat transfer, and stabilizing a cup filled with a liquid beverage material, said method comprising the steps of: selecting an empty cup, which cup comprises a cup mouth with an inner diameter; selecting a round cup cover, which cup cover comprises: a protruding portion; a hollow portion corresponding to said protruding portion; and a lip portion surrounding said protruding portion and said hollow portion; filling said empty cup at least partially with a liquid beverage material; placing said cup cover on top of said at least partially filled cup, such that said protruding portion extends into said cup mouth of said at least partially cup; covering said cup mouth with said lip portion of said cup cover such that said lip portion extends beyond said cup mouth of said at least partially filled cup and thus minimizing insects and debris from entering said at least partially filled cup; minimizing instability of said at least partially filled cup with said cup cover disposed on said at least partially filled cup; insulating said liquid beverage material in said at least partially filled cup with said cup cover; inadvertently moving said at least partially filled cup such that said cup cover moves within a predetermined distance on top of said at least partially filled cup, which predetermined distance is a gap being sufficiently large to minimize instability of said at least partially filled cup; minimizing spilling of liquid beverage material from said at least partially filled cup with said cup cover by the impact of said liquid beverage material in said at least partially filled cup; picking up said at least partially filled cup; removing said cup cover from said at least partially filled cup; drinking from said at least partially filled cup; and replacing said cup cover on said at least partially filled cup.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, if any, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of cups, which may possibly be utilized or adapted for use with at least one possible embodiment of the present application, may possibly be found in the following U.S. Pat. No. applications: No. D623,900, having the title "DRINKING CUP," published on Sep. 21, 2010; No. D622,105, having the title "CUP," published on Aug. 24, 2010; No. 7,780,033, having the title "PLURAL CHAMBER DRINKING CUP," published on Aug. 24, 2010; No. D621,221, having the title "TEA CUP," published on Aug. 10, 2010; and NO. D620,760, having the title "CUP," published on Aug. 3, 2010.

The patents, patent applications, and patent publications listed above in the preceding paragraph(s) are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

All of the references and documents cited in any of the documents cited herein, except for the exceptions indicated herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of covering, preventing debris and insects from entering, minimizing heat transfer, and stabilizing a cup filled with a liquid beverage material, said method comprising the steps of:

- selecting an empty cup, which cup comprises a cup mouth with an inner diameter of about two and seven-eighth inches;
- selecting a round cup cover, which cup cover comprises:
  - a hard, smooth plastic material configured to:
    - minimize dirt accumulation on said cup cover;
    - maximize cleanability; and
    - be sufficiently sturdy to be handled and to minimize breaking or deforming of said cup cover during handling and during use;
  - a color on the top of said cup cover configured to reflect heat away from said cup cover;
  - a color on the bottom of said cup cover configured to reflect heat back toward the contents of said cup;
  - a weight about one and one-tenth ounces, which corresponds to a proportion to the weight of said cup and to the weight of a liquid beverage material, and configured to substantially minimize instability of the cup with liquid beverage material and minimize spilling of liquid beverage material from the cup;
  - a diameter of about three and five-eighth inches;
  - a lip portion comprising:
    - an outer diameter of about three and five-eighth inches; and
    - a thickness of about one-eighth of an inch;
  - a protruding portion comprising:
    - a diameter of about two and one-half inches being concentric with said outer diameter of said lip portion;
    - said diameter being substantially greater than the radius of said cup and substantially but leaving a gap between said protruding portion and at least one area of the periphery of said cup mouth; and
    - a height, protruding from said lip portion, of about three-eighths of an inch;
  - a hollow portion comprising:
    - a diameter of about two and one-fourth inches being concentric with said outer diameter of said lip portion and said diameter of said protruding portion; and
    - a depth of about seven-sixteenths of an inch;

filling said empty cup at least partially with a liquid beverage material;

placing said cup cover on top of said at least partially filled cup, such that said protruding portion fits extends into said cup mouth of said at least partially cup;

covering said cup mouth with said lip portion of said cup cover such that said lip portion extends beyond the outer diameter of said at least partially filled cup and thus minimizing insects and debris from entering said at least partially filled cup;

minimizing instability of said at least partially filled cup with said cup cover disposed on said at least partially filled cup;

insulating said liquid beverage material in said at least partially filled cup with said cup cover;

inadvertently moving said at least partially filled cup such that said cup cover moves within a predetermined distance of three-eighths of an inch on top of said at least partially filled cup, which predetermined distance is a gap being sufficiently large to minimize instability of said at least partially filled cup;

minimizing spilling of liquid beverage material from said at least partially filled cup with said cup cover by the impact of said liquid beverage material in said at least partially filled cup;

picking up said at least partially filled cup;

removing said cup cover from said at least partially filled cup;

drinking from said at least partially filled cup;

replacing said cup cover on said at least partially filled cup;

removing said cup cover from said cup;

opening a beverage can, which beverage can comprises a lip portion and a can mouth;

placing said cup cover on said opened beverage can such that said hollow portion of said cup cover fits over said lip portion and said can mouth of said opened beverage can;

minimizing insects and debris from entering said opened beverage can;

minimizing instability of said opened beverage can with said cup cover disposed on said beverage can;

insulating said liquid beverage material in said beverage can with said cup cover;

inadvertently moving said beverage can such that said cup cover rocks on top of said beverage can and minimizing instability of said beverage can;

minimizing spilling of liquid beverage material from said beverage can with said cup cover by the impact of said liquid beverage material in said at least partially filled cup;

picking up said beverage can;

removing said cup cover from said beverage can; and drinking from said beverage can.

2. A method of covering, preventing debris and insects from entering, minimizing heat transfer, and stabilizing a cup filled with a liquid beverage material, said method comprising the steps of:

selecting an empty cup, which cup comprises a cup mouth with an inner diameter and a radius;

selecting a round cup cover, which cup cover comprises:

a protruding portion, which protruding portion comprises a diameter in the range of about seventy percent of the radius of the cup mouth to about ninety percent of the radius of the cup mouth;

a hollow portion corresponding to said protruding portion; and a lip portion surrounding said protruding portion and said hollow portion;

filling said empty cup at least partially with a liquid beverage material;

placing said cup cover on top of said at least partially filled cup, such that said protruding portion extends into said cup mouth of said at least partially cup;

covering said cup mouth with said lip portion of said cup cover such that said lip portion extends beyond said cup mouth of said at least partially filled cup and thus minimizing insects and debris from entering said at least partially filled cup;

minimizing instability of said at least partially filled cup with said cup cover disposed on said at least partially filled cup;

insulating said liquid beverage material in said at least partially filled cup with said cup cover;

inadvertently moving said at least partially filled cup such that said cup cover moves within a predetermined distance on top of said at least partially filled cup, which predetermined distance is a gap being sufficiently large to minimize instability of said at least partially filled cup;

minimizing spilling of liquid beverage material from said at least partially filled cup with said cup cover by the impact of said liquid beverage material in said at least partially filled cup;

picking up said at least partially filled cup;

removing said cup cover from said at least partially filled cup;

drinking from said at least partially filled cup; and replacing said cup cover on said at least partially filled cup.

3. A beverage container cover for performing the method according to claim 2, said beverage container cover comprising:

a round shape;

a material configured to:

minimize dirt accumulation on said beverage container cover;

maximize cleanability; and be sufficiently sturdy to be handled and to minimize breaking or deforming of said beverage container cover during handling and during use;

a color on the top of said beverage container cover configured to reflect heat away from said beverage container cover;

a color on the bottom of said beverage container cover configured to reflect heat back toward the contents of said cup;

a weight about one and one-tenth ounces, which corresponds to a proportion to the weight of a beverage container and to the weight of a liquid beverage material, and configured to substantially minimize instability of the beverage container with liquid beverage material and minimize spilling of liquid beverage material from the beverage container;

a diameter of about three and five-eighth inches;

a lip portion comprising:

an outer diameter of about three and five-eighth inches; and a thickness of about one-eighth of an inch;

a protruding portion comprising:

a diameter of about two and one-half inches being concentric with said outer diameter of said lip portion;

said diameter being substantially greater than the radius of a beverage container and substantially but leaving a gap between said protruding portion and at least one area of the periphery of a mouth of a beverage container; and a height, protruding from said lip portion, of about three-eighths of an inch;

a hollow portion comprising:

a diameter of about two and one-fourth inches being concentric with said outer diameter of said lip portion and said diameter of said protruding portion; and a depth of about seven-sixteenths of an inch.

* * * * *